US012110685B2

(12) United States Patent
Magin et al.

(10) Patent No.: US 12,110,685 B2
(45) Date of Patent: Oct. 8, 2024

(54) MULTI-LEVEL CARRIER FOR CEILING PANELS AND CEILING PANEL SYSTEM

(71) Applicant: CertainTeed Ceilings Corporation, Malvern, PA (US)

(72) Inventors: Michael Magin, Cumming, GA (US); Birsen Kilinc, Marietta, GA (US); David A. Bailey, Norcross, GA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 400 days.

(21) Appl. No.: 17/378,182

(22) Filed: Jul. 16, 2021

(65) Prior Publication Data

US 2022/0018127 A1 Jan. 20, 2022

Related U.S. Application Data

(60) Provisional application No. 63/053,174, filed on Jul. 17, 2020.

(51) Int. Cl.

| | |
|---|---|
| ***E04B 9/24*** | (2006.01) |
| ***E04B 9/18*** | (2006.01) |
| ***E04B 9/22*** | (2006.01) |
| ***E04B 9/28*** | (2006.01) |
| ***E04B 9/36*** | (2006.01) |

(52) U.S. Cl.

CPC ..... *E04B 9/28* (2013.01); *E04B 9/18* (2013.01); *E04B 9/225* (2013.01); *E04B 9/366* (2013.01)

(58) Field of Classification Search

CPC ... E04B 9/28; E04B 9/18; E04B 9/225; E04B 9/366; E04B 9/065; E04B 9/36

See application file for complete search history.

(56) References Cited

U.S. PATENT DOCUMENTS

| | | | | |
|---|---|---|---|---|
| 4,197,923 | A | 4/1980 | Harris | |
| 4,227,355 | A | 10/1980 | Wendt | |
| 5,115,611 | A * | 5/1992 | Lim | E04B 9/363 52/762 |
| 9,353,521 | B2 | 5/2016 | Waters | |
| 9,663,949 | B1 | 5/2017 | Caste | |
| 9,920,525 | B1 | 3/2018 | Underkofler | |

(Continued)

FOREIGN PATENT DOCUMENTS

WO 2018007600 A1 1/2018

*Primary Examiner* — Amy J. Sterling

(74) *Attorney, Agent, or Firm* — McDonnell Boehnen Hulbert & Berghoff LLP

(57) ABSTRACT

The present disclosure relates generally to ceiling panel carriers, for example, suitable for forming a ceiling surface by supporting a plurality of ceiling panels. The present disclosure relates more particularly to a carrier configured to mount ceiling panels at varying heights. The carrier includes an elongate support structure extending in a longitudinal direction and a plurality of attachment projections positioned along the length of the carrier. Each of the attachment projections extends down from the support structure and is configured to hold a ceiling panel. The attachment projections include a first group with a body and an upper hanger that has a first upper flange extending from the body in the longitudinal direction. The attachment projections also include a second group with a body and a lower hanger that has a first lower flange extending from the body in the longitudinal direction.

19 Claims, 11 Drawing Sheets

(56) References Cited

U.S. PATENT DOCUMENTS

| | | | | |
|---|---|---|---|---|
| 10,174,501 | B1 * | 1/2019 | Underkofler | E04B 9/16 |
| 10,294,675 | B2 * | 5/2019 | Langeveld | E04F 13/083 |
| 10,947,724 | B2 * | 3/2021 | Langeveld | E04B 9/065 |
| 11,608,636 | B1 * | 3/2023 | Underkofler | E04B 9/068 |
| 2015/0233116 | A1 | 8/2015 | Mayer | |
| 2018/0009155 | A1 | 1/2018 | Langeveld | |
| 2018/0245344 | A1 | 8/2018 | Venjen-Jensen | |
| 2019/0024373 | A1 | 1/2019 | Langeveld | |
| 2019/0186134 | A1 | 6/2019 | Langeveld | |
| 2019/0329485 | A1 | 10/2019 | Langeveld | |
| 2020/0079003 | A1 | 3/2020 | van Rees | |
| 2020/0109560 | A1 | 4/2020 | Headley | |
| 2021/0301525 | A1 * | 9/2021 | Baxter | E04B 9/245 |

* cited by examiner

MULTI-LEVEL CARRIER FOR CEILING PANELS AND CEILING PANEL SYSTEM

CROSS-REFERENCE TO RELATED APPLICATIONS

This application claims the benefit of priority of U.S. Provisional Patent Application no. 63/053,174, filed Jul. 17, 2020, which is hereby incorporated herein by reference in its entirety.

BACKGROUND OF THE DISCLOSURE

1. Field of the Disclosure

The present disclosure relates generally to ceiling panel carriers, for example, suitable for forming a ceiling surface by supporting a plurality of ceiling panels. The present disclosure relates more particularly to a carrier for supporting linear ceiling panels at more than one height.

2. Technical Background

Panels are convenient and effective for constructing architectural surfaces. The panels may be pre-fabricated and shipped to the construction location, allowing for efficient installation that covers a large surface area. If damaged, the panels can be wholly replaced, rather than requiring a custom repair of the architectural surface. In some cases, the panels can be removed to provide access to the area behind the panel.

Panels that are used to form an architectural surface, such as a ceiling, are often supported by carrier or a structural grid that holds the panels in place. This allows flexibility in the design of the panels, because the supporting grid provides the structural integrity needed for the architectural surface, thereby allowing the design of the panels to address aesthetic and acoustic requirements of the ceiling system. Carriers typically hold the panels in a row or an array to provide an attractive planar ceiling surface. The use of carriers also allows a simple solution for providing complex ceiling designs. Different types of carriers or grids can be installed over different areas of the ceiling to provide the ceiling design with areas that have different aesthetic qualities. While such complex ceiling structures are often aesthetically interesting, they require the use of various different ceiling carriers and panel types in a single installation. The use of various different components to form the ceiling structure increases installation complexity and costs.

The present inventors have recognized that a ceiling system that allows for more variety in the ceiling aesthetics without adding significant complexity in installation or parts would be attractive to architects and builders.

SUMMARY OF THE DISCLOSURE

In one aspect, the present disclosure provides a carrier configured to mount ceiling panels at varying heights, the carrier having a length extending in a longitudinal direction from a first end to a second end, the carrier comprising:

- an elongate support structure extending in the longitudinal direction;
- a plurality of attachment projections positioned along the length of the carrier, each of the attachment projections extending down from the support structure and being configured to hold a ceiling panel, the plurality of attachment projections including:

- a first group of attachment projections, each attachment projection in the first group including a body and an upper hanger comprising a first upper flange extending from the body in the longitudinal direction, the upper hanger being positioned at a first elevation, and
  - a second group of attachment projections, each attachment projection in the second group including a body and a lower hanger comprising a first lower flange extending from the body in the longitudinal direction, the lower hanger being positioned at a second elevation that is further from a top side of support structure than the first elevation.

In another aspect, the disclosure provides a ceiling panel system comprising:

- a first carrier according to the disclosure;
- a first linear panel secured to the upper hanger of a first attachment projection of the first group of attachment projections; and
- a second linear panel secured to the lower hanger of a first attachment projection of the second group of attachment projections.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that adding aesthetic variation within a ceiling system also adds significantly more parts and installation complexity. The present inventors have determined that a ceiling system that allows for more variety in the ceiling aesthetics without adding significant complexity in installation or parts would be attractive to architects and builders.

Accordingly, one aspect of the disclosure is a carrier configured to mount ceiling panels at varying heights. The carrier has a length extending in a longitudinal direction from a first end to a second end. The carrier includes an elongate support structure extending in the longitudinal direction and a plurality of attachment projections positioned along the length of the carrier. Each of the attachment projections extends down from the support structure and is configured to hold a ceiling panel. The plurality of attachment projections includes a first group of attachment projections and a second group of attachment projections. Each attachment projection in the first group includes a body and an upper hanger having a first upper flange extending from the body in the longitudinal direction. The upper hanger is positioned at a first elevation. Likewise, each attachment projection in the second group also includes a body and includes a lower hanger having a first lower flange extending from the body in the longitudinal direction. The lower hanger is positioned at a second elevation that is further from a top side of support structure than the first elevation.

Figure 1:
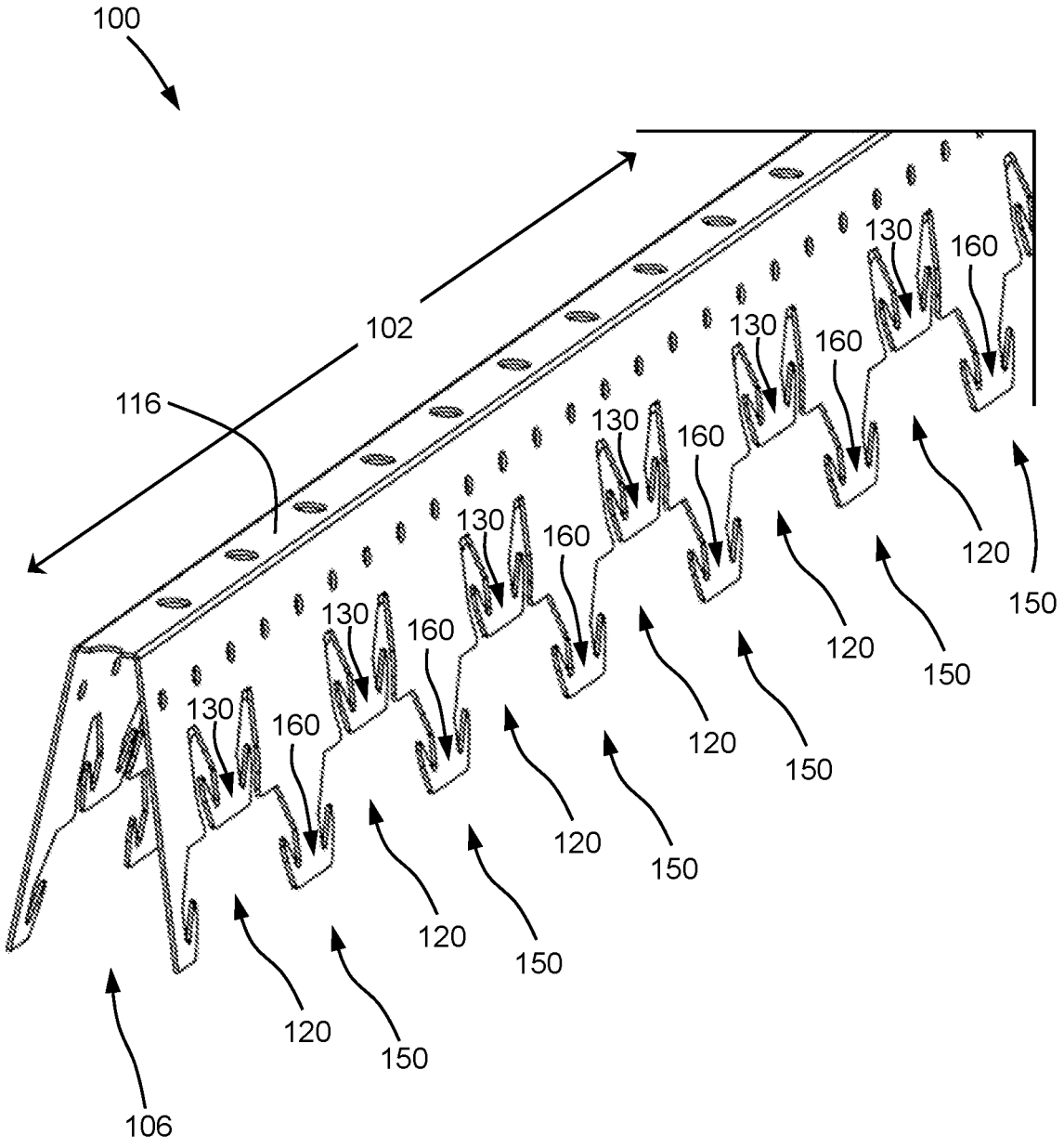
FIG. 1 is a schematic perspective view of a portion of a carrier for a ceiling panel according to an embodiment of the disclosure.

Such a carrier is shown in perspective view in FIG. 1. Carrier 100 is an elongate structure that extends in a longitudinal direction 102 from a first end 106 to a second end 108 (see FIG. 2). Carrier 100 includes a support structure 116 that extends along the longitudinal direction 102 and a plurality of attachment projections 120, 150 that extend downward from support structure 116. The attachment projections 120, 150 are configured to hold ceiling panels at different elevations, as explained in more detail below. The attachment projections include a first group of the attachment projections 120 and a second group of attachment projections 150. Each of the attachment projections 120 in the first group includes an upper hanger 130, and each of the attachment projections 150 in the second group includes a lower hanger 160.

Figure 2:
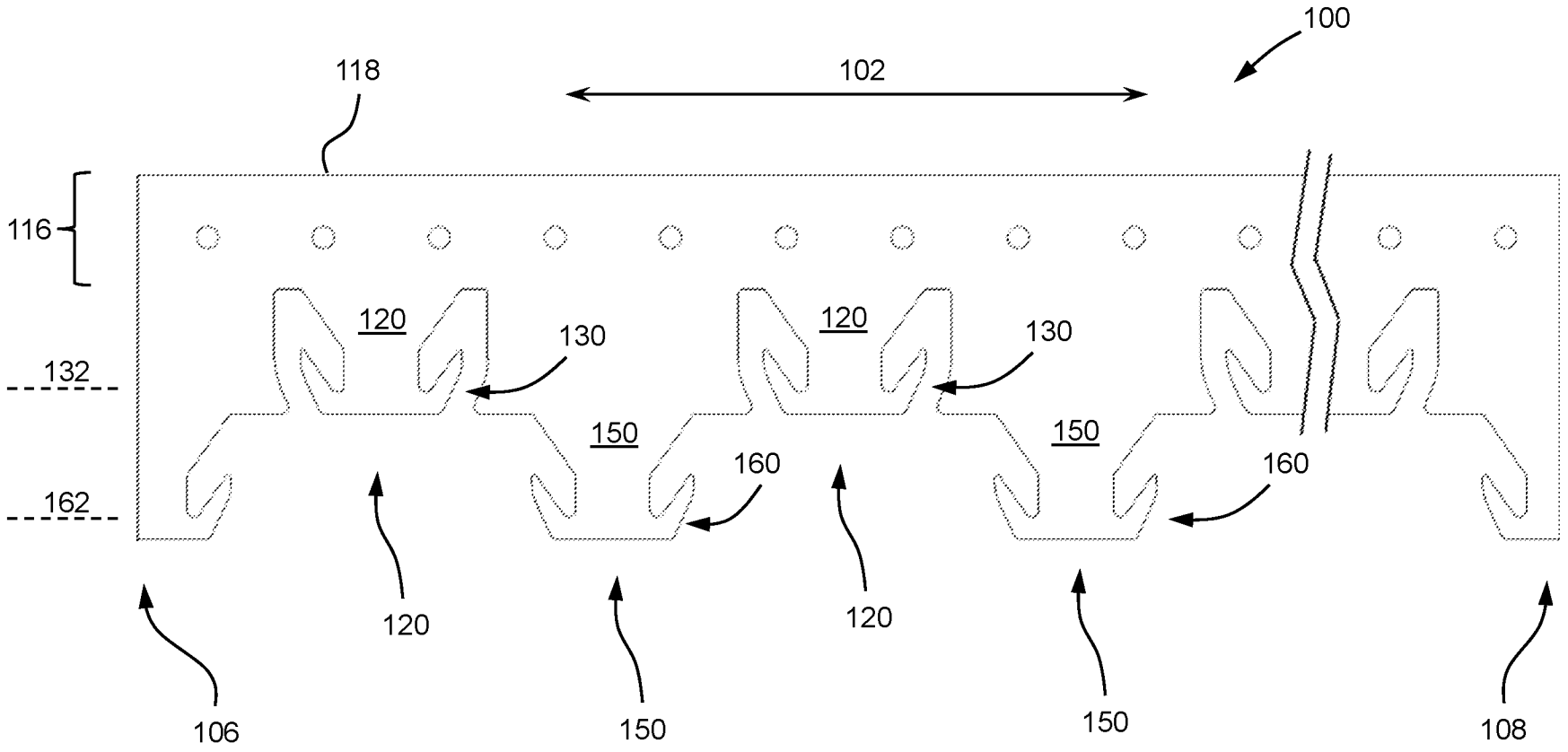
FIG. 2 is a schematic plan view of a portion of the carrier of FIG. 1.

As shown in FIG. 2, each of the attachment projections 120 in the first group includes a body 122 and an upper hanger 130. Similarly, each of the attachment projections 150 in the second group also includes a body 152 and a lower hanger 160. The upper hangers 130 of the attachment projection 120 of the first group and the lower hangers 160 of the attachment projections 150 of the second group are disposed at different distances from the top side 118 of support structure 116. Accordingly, that the upper hangers 130 and lower hangers 160 are positioned at different elevations. In particular, the upper hangers 130 are disposed at a first elevation 132 and the lower hangers 150 are disposed at a second elevation 162 which is lower and further from the top side 118 of the support structure 116.

The different elevation of the upper hangers 130 and the lower hangers 160 position ceiling panels attached to the attachment projections 120, 150 at different heights. For example, as shown in the ceiling panel system illustrated in FIG. 5, which is described in more detail below, the attachment projections of carrier 100 hold the linear ceiling panels 180A, 180B that are attached thereto at different heights.

Figure 3:
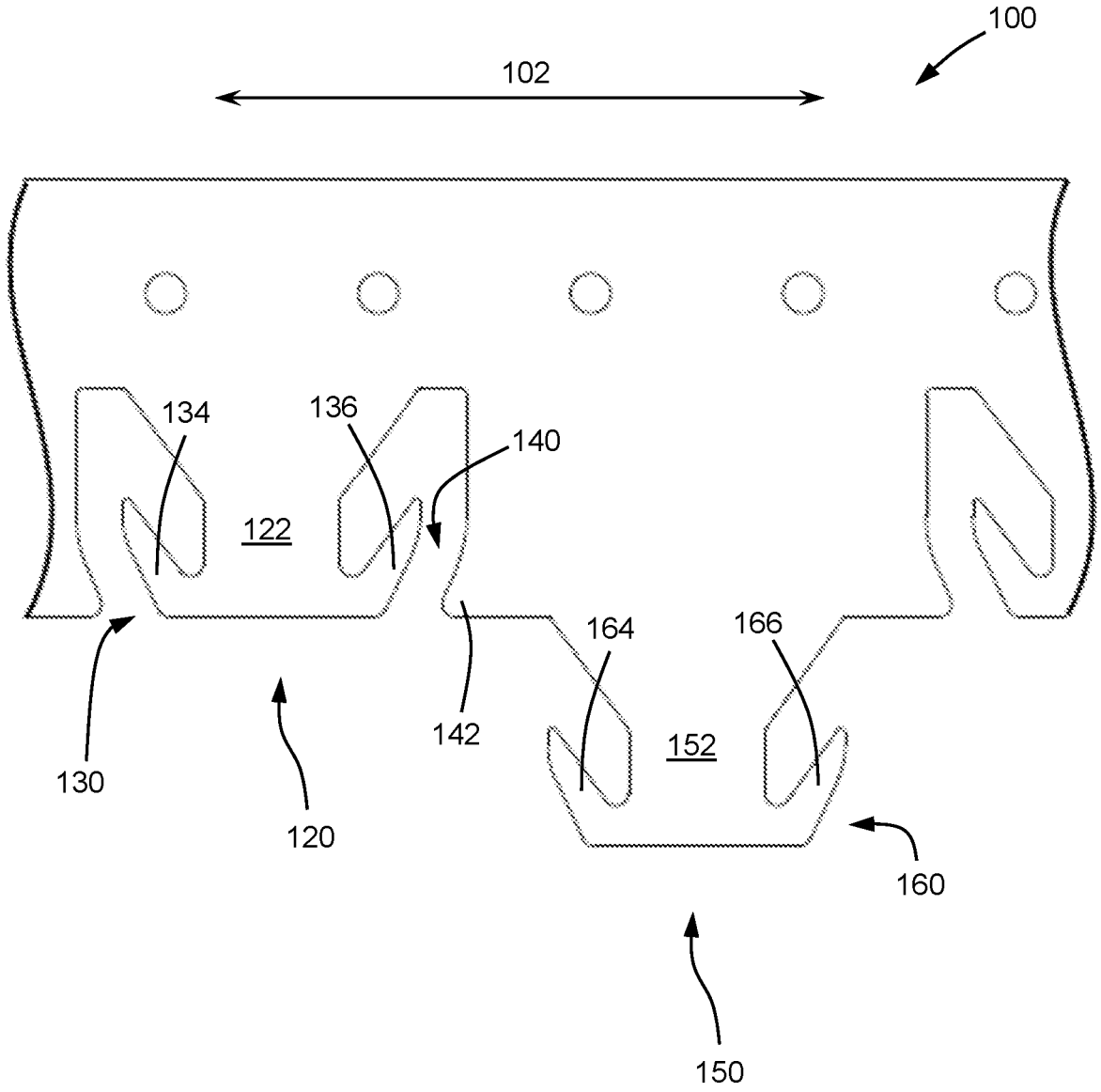
FIG. 3 is a schematic detailed plan view of a portion of the carrier of FIG. 1.

Features of the attachment projections 120, 150 are described in more detail with respect to FIG. 3, which shows a further detailed schematic plan view of a portion of the attachment projections 120, 150 of carrier 100. As shown, upper hanger 130 has a first upper flange 134 extending from body 122. The first upper flange 134 extends from body 122 in the longitudinal direction 102 so as to engage a cooperating structure of a ceiling panel, as explained in more detail below. Likewise, lower hanger 160 has a first lower flange 164 extending from body 152 in the longitudinal direction 102. First lower flange 164 is configured to engage a ceiling panel in a similar manner as first upper flange 134.

The manner in which the upper hanger 130 and lower hanger 160 support a ceiling panel is described in more detail below with reference to FIG. 6. Briefly, a lip extending from a sidewall of the ceiling panel hooks over the first upper flange 134 or first lower flange 164, such that the respective flange 134, 164 supports the ceiling panel via the lip.

In certain embodiments of the carrier as otherwise described herein, the upper hanger of each attachment projection of the first group of attachment projections includes a second upper flange that extends from the respective body in a direction opposite the respective first upper flange. For example, as shown in FIG. 3, upper hanger 130 of attachment projection 120 includes a second upper flange 136 that extends from body 122 in a direction opposite to first upper flange 134 along the longitudinal direction 102. Similarly, in certain embodiments of the carrier as otherwise described herein, the lower hanger of each attachment projection of the second group of attachment projections includes a second lower flange that extends from the respective body in a direction opposite the respective first lower flange. For example, like upper hanger 130, lower hanger 160 of attachment projection 150 includes a second lower flange 166 extending from body 152 in a direction opposite to first lower flange 164 along the longitudinal direction 102.

Providing the upper hanger 130 with both the first upper flange 134 and the second upper flange 136 allows a ceiling panel supported by the attachment projection 120 to be secured on two sides, which adds stability. Moreover, because the first upper flange 134 and second upper flange 136 extend in opposite trajectories along the longitudinal direction, the ceiling panel may wrap around the upper hanger 130 thereby hindering removal of the ceiling panel from the upper hanger. Likewise, the first lower flange 164 and second lower flange 166 provide a similar advantage when using the lower hanger 160.

In certain embodiments of the carrier as otherwise described herein, each of the flanges is angled upward toward the support structure. For example, both of the upper flanges 134, 136 of upper hanger 130 extend outward from body 122 of attachment projection 120 in opposing trajectories of the longitudinal direction 102 and are angled upward toward support structure 116. Likewise, the lower flanges 164, 166 of lower hanger 160 also extend outward from body 152 of attachment projection 150 in opposing trajectories of the longitudinal direction 102 and are also angled upward toward support structure 116. The upward angle of the flanges aids in retaining a ceiling panel that is attached to the respective hanger. With the flanges pointing upward, the ceiling panel must be pushed upward in order for the lip of the ceiling panel that overhangs each respective flange to disengage from the respective hanger. Accordingly, gravity aids in retaining the ceiling panel on the carrier by urging the lip down onto the upwardly angled flange.

In certain embodiments of the carrier as otherwise described herein, the first group of attachment projections are interspersed along the length of the carrier with the second group of attachment projections. For example, as shown in FIG. 1, the attachment projections 120 of the first group of attachment projections are interspersed with the attachment projections 150 of the second group of attachment projections, such that many of the attachment projections 120 of the first group are adjacent to attachment projections 150 of the second group. Indeed, in carrier 100, the attachment projections 120 of the first group alternate with the attachment projections 150 of the second group along the length of the carrier 100. Accordingly, aside from the attachment projections at the ends, each of the of the attachment projections 120 of the first group is surrounded by two attachment projections 150 of the second group and vice versa. In other embodiments, however, the attachment projections of the first and second groups are interspersed in another pattern or randomly. For example, in some embodiments, the attachment projections along the length of the carrier are bunched into clusters of attachment projections of the first group and clusters of attachment projections of the second group. The term interspersed, as used herein, relates to a configuration where at least one attachment projection of the first group is positioned along the length of the carrier between two attachment projections of the second group and at least one attachment projection of the second group is positioned along the length of the carrier between two attachment projections of the first group For example, in carrier 100, most of the attachment projections of the first group are between and adjacent to two attachment projections of the second group. In other embodiments, the attachment projection of the first group that is between two attachment projections of the second group may not be adjacent to both attachment projections of the second group, and likewise for an attachment projection of the second group that is between attachment projections of the first group.

Alternatively, in some embodiments, the attachment projections are not interspersed. For example, in some embodiments, the carrier includes a group of attachment projections having upper hangers at one end and a group of attachment projections having lower hangers at the other end. Further still, in some embodiments, the attachment projections of the first group are positioned toward the center of the carrier and the attachment projections of the second group are positioned at the ends of the carrier. On the other hand, in some embodiments, the attachment projections of the second group are positioned toward the center of the carrier and the attachment projections of the first group are positioned at the ends.

In certain embodiments of the carrier as otherwise described herein, the first upper flange of each upper hanger of the first group of attachment projections is flanked along the longitudinal direction by a respective upper guard. For example, as shown in FIG. 3, the first upper flange 134 of upper hanger 130 is positioned adjacent to an upper guard 140 along the longitudinal direction 102 of carrier 100. The upper guard 140 impedes movement of a ceiling panel that is secured to the attachment projection 120 from moving away from the body 122 of attachment projection 120 in a manner that might disengage the ceiling panel from the respective flanges 134, 136 of the upper hanger 130.

In certain embodiments of the carrier as otherwise described herein, each upper guard extends from the body of a respective adjacent attachment projection of the second group of attachment projections. For example, the upper guards 140 of carrier 100 extend from either side of the body 152 of each of the attachment projections 150 of the second group of attachment projections. Accordingly, the guards 140 and the bodies 152 of the attachment projections 150 structurally support one another and add strength to the configuration of carrier 100. In other embodiments, the upper guards are distinct from the neighboring attachment projections. For example, in some embodiments, the upper guards extend independently from the support structure on either or both sides of a respective attachment projection of the first group of attachment projections.

Figure 7:
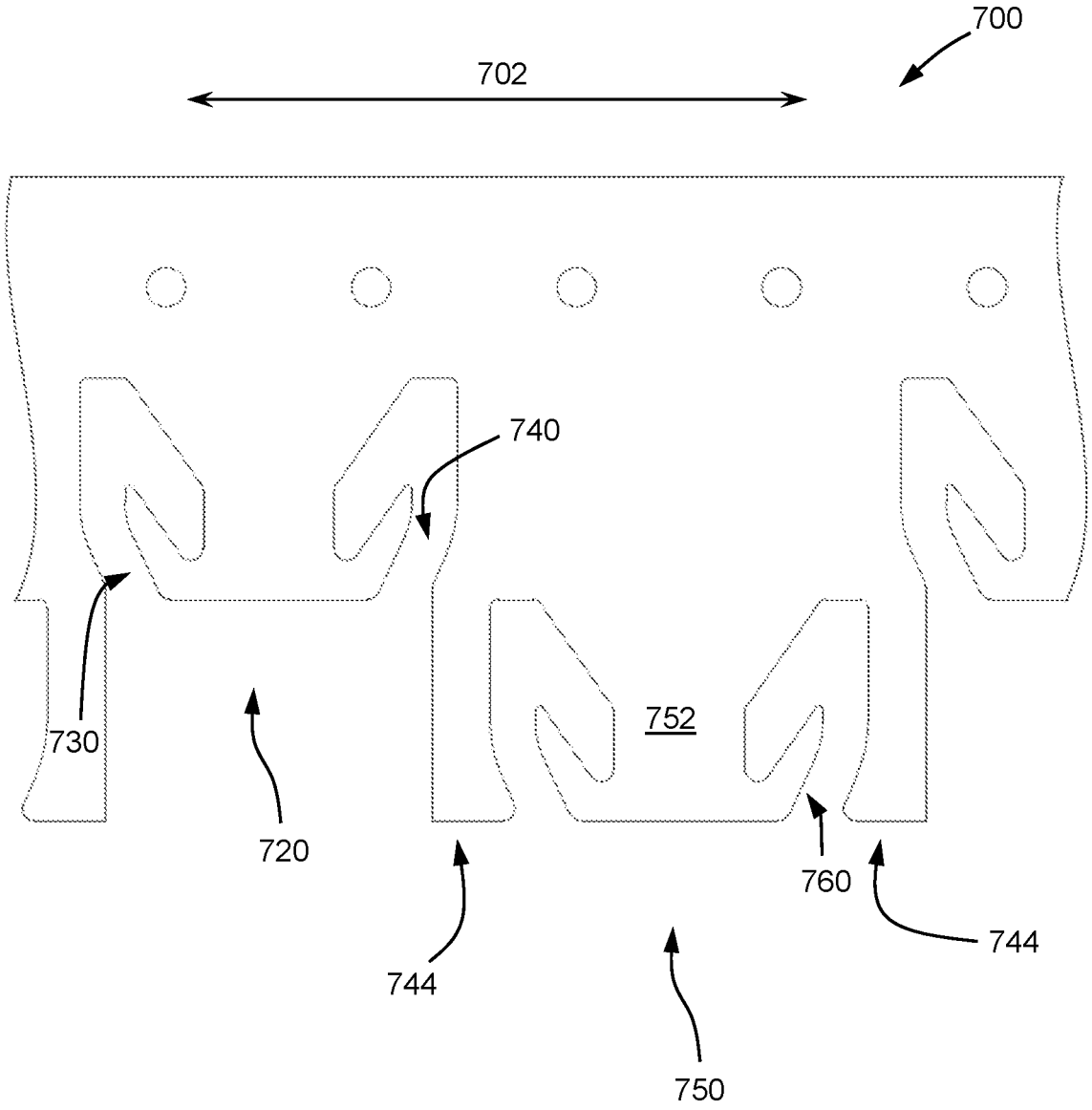
FIG. 7 is a schematic detailed plan view of a portion of a carrier according to another embodiment of the disclosure.

In certain embodiments of the carrier as otherwise described herein, the first lower flange of each lower hanger of the second group of attachment projections is flanked along the longitudinal direction by a respective lower guard. A plan view of a portion of such an embodiment of a carrier is shown in FIG. 7. Carrier 700 includes a support structure 716 that extends in a longitudinal direction 702 and includes a plurality of attachment projections 720, 750 extending downward from the support structure along its length. Each attachment projection 720 in a first group includes an upper hanger 730 while each attachment projection 750 in a second group includes a lower hanger 760. The carrier 700 further includes upper guards 740 that extend from the sides of the body 752 of the attachment projections 750 of the second group. Further, lower guards 744 extend down from the upper guards 740 and flank the attachment projections 750 of the second group of attachment projections. Similar to the upper guards described above, the lower guards 744 help retain the ceiling panel on the lower hanger 760 by hindering the sidewall of the ceiling panel from moving outward along the longitudinal length. Accordingly, the lower guard 744 helps prevent removal of a ceiling panel from the lower hanger 760.

In other embodiments, the carrier does not include the lower guards. For example, in certain embodiments of the carrier as otherwise described herein, the space between neighboring lower hangers along the length of the carrier is open. For example, as shown in FIG. 2, the space between the lower hangers 160 of attachment projections 150 along the longitudinal direction is open. An attachment projection 120 of the first group of attachment projections is positioned between the attachment projections 150 of the second group, but the attachment projection 120 does not extend downward to the lower elevation of the lower hangers 160. Accordingly, the carrier does not include any structure or material between attachment projections 150 of the second group that are nearest one another along the length of the carrier.

In certain embodiments of the carrier as otherwise described herein, each upper guard includes a protrusion extending toward a neighboring upper flange. For example, as shown in FIG. 3, each upper guard 140 of carrier 100 includes an upper guard protrusion 142 that extends along the longitudinal direction toward a respective neighboring upper flange 134, 136. The upper guard protrusion 142 is configured to engage the outer surface of a ceiling panel hung on the respective upper flange 134, 136 and hold the ceiling panel in place. The lower guard 744 shown in FIG. 7 includes a similar lower guard protrusion 746 that extends toward a neighboring lower flange 764, 766 to hold a respective ceiling panel on the lower hanger 760.

In certain embodiments of the carrier as otherwise described herein, the first elevation is at a first distance from the top side of the support structure, and the second elevation is at a second distance from the top side of the support structure. For example, in some embodiments the distance between the elevation of the upper hangers, i.e., the first elevation, and the top side of the support structure, is a first distance that is at least 0.75 inches, e.g., at least 1 inch, e.g., at least 1.5 inches. Further, in certain embodiments of the carrier as otherwise described herein, the first distance is no more than 3 inches, e.g., no more than 4 inches, e.g., no more than 5 inches. For example, in some embodiments, the first distance is in a range from 0.75 inches to 5 inches, e.g., from 1 inch to 4 inches, e.g., from 1.5 inches to 3 inches.

Likewise, in some embodiments the distance between the elevation of the lower hangers, i.e., the second elevation, and the top side of the support structure, is a second distance that is at least 1.5 inches, e.g., at least 2 inches, e.g., at least 2.5 inches. Further, in certain embodiments of the carrier as otherwise described herein, the second distance is no more than 4 inches, e.g., no more than 6 inches, e.g., no more than 8 inches. For example, in some embodiments, the second distance is in a range from 1.5 inches to 8 inches, e.g., from 2 inches to 6 inches, e.g., from 2.5 inches to 4 inches.

Further, in certain embodiments of the carrier as otherwise described herein, a difference between the first distance and the second distance is at least 0.5 inches, e.g., at least 0.75 inches. In other words, in some embodiments, the distance between the first elevation where the upper hangers are positioned and the second elevation where the lower hangers are positioned is at least 0.5 inches. Moreover, in certain embodiments of the carrier as otherwise described herein, a difference between the first distance and the second distance is no more than 1.5 inches, e.g., no more than 2 inches, e.g., no more than 3 inches. For example, in some embodiments, the difference between the first distance and the second distance is in a range of 0.5 inches to 3 inches, e.g., from 0.75 inches to 2 inches, e.g., from 0.75 inches to 1.5 inches.

In certain embodiments of the carrier as otherwise described herein, a cross section of the carrier along the length includes first and second legs connected by a central portion, and the plurality of attachment projections are formed along both legs. For example, carrier 100 includes such a cross section, as can be seen in FIG. 1. A more detailed view of the cross sectional shape of carrier 100 is shown in the end view of FIG. 4. The cross-section of carrier 100 includes a first leg 112 and a second leg 114 that are connected by a central portion 110. Each of the first leg 112 and second leg 114 include attachment projections in each of the first group and the second group. In other words, as can be seen in FIG. 1, the first leg 112 and second leg 114 both include attachment projections 120 having an upper hanger 130 and both also include attachment projections 150 having a lower hanger 160. Referring again to FIG. 4, the upper hangers 130 are positioned at the first elevation 132 and the second hangers 160 are positioned at the second elevation 162. The central portion 110 is part of the support structure 116 and also forms the top side 118 of carrier 100.

In other embodiments, the carrier includes a different cross section. For example, in some embodiments, the carrier has the shape of a V with first and second legs that are directly attached to one another. In other embodiments, the cross section of the carrier has an L-shape, for example, including a flange along the top and single downward-extending web with the attachment projections formed therein. Further still, in some embodiments, the carrier is a flat plate. Such a plate may be structurally supported on another beam or have sufficient rigidity to hang without additional support.

In certain embodiments of the carrier as otherwise described herein, each attachment projection on the first leg is paired with an attachment projection on the second leg that is disposed at the same position along the length of the carrier. For example, as shown in FIG. 1, the first leg 112 of carrier 100 is a mirror image of the second leg 114. At each location along the length of the carrier where the first leg 112 includes an attachment projection 120 of the first group, the second leg 114 also includes such an attachment projection that is paired with the attachment projection 120 on the first leg 112. Likewise, at each location along the length of the carrier where the first leg 112 includes an attachment projection 150 of the second group, the second leg 114 also includes such an attachment projection that is paired with the attachment projection 150 on the first leg. Accordingly, the carrier 100 supports ceiling panels at two locations along their length.

Figure 4:
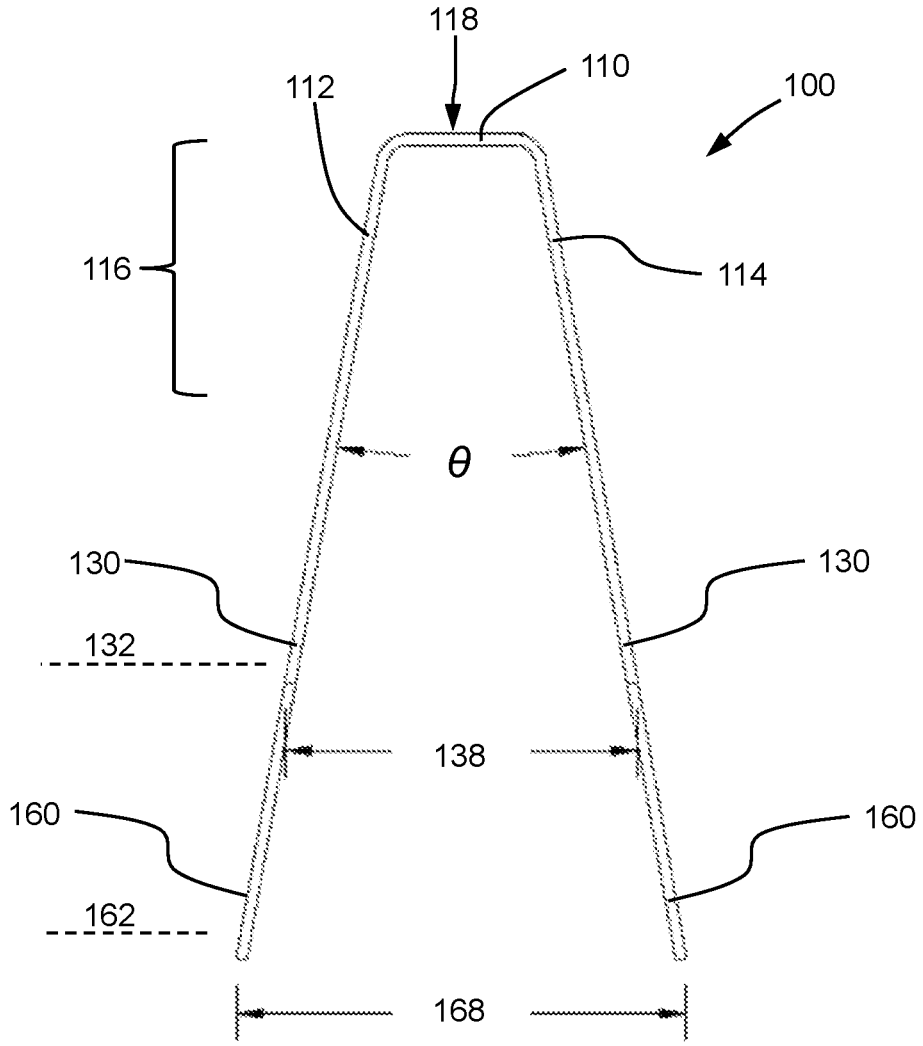
FIG. 4 is a schematic end view of the carrier of FIG. 1.

In certain embodiments of the carrier as otherwise described herein, the legs are disposed at an acute angle to one another. For example, as shown in FIG. 4, first leg 112 is disposed at an angle θ from second leg 114. In some embodiments, the angle between the first leg and the second leg is in a range of 5 to 35 degrees. The diverging angle between the first leg 112 and second leg 114 places the hangers further apart without increasing the width of the central portion 110, which would require additional material. Placing the hangers on each carrier further apart reduces the span that the ceiling panel extends from one carrier to the next, thereby increasing the stability provided by the carrier. Likewise, the angled configuration of the first leg 112 and second leg 114 allows a group of carriers to be nested in a stack, which is advantageous for packaging and transportation.

In certain embodiments of the carrier as otherwise described herein, the upper hangers in each pair of attachment projections of the first group of attachment projections are closer together than the lower hangers in each pair of attachment projections of the second group of attachment projections. For example, as shown in FIG. 4, the distance 138 between the upper hangers 130 on the first leg 112 of carrier 100 and the upper hangers 130 on the second leg 114 is smaller than the distance 168 between the lower hangers 160 on the first leg 112 and the lower hangers 160 on the second leg 114. The greater distance between the lower hangers 160 compared to the distance between the upper hangers 130 reduces the span that ceiling panels coupled to the lower hangers must extend from one carrier to the next. This reduced span is advantageous because it provides added security to ceiling panels secured to the lower hangers 160 of carrier 100. Thus, while ceiling panels secured to the upper hangers 130 are supported by the upper guards 140, the ceiling panels secured to lower hangers can extend over a reduced span between carriers to compensate for the lack of a lower guard.

In certain embodiments of the carrier as otherwise described herein, a width of the carrier is at least 0.75 inches, e.g., at least 1 inch, e.g., at least 1.25 inches. Further, in certain embodiments of the carrier as otherwise described herein, a width of the carrier is no more than 6 inches, e.g. no more than 4 inches, e.g., no more than 2.5 inches. For example, in some embodiments, the width of the carrier is in a range from 0.75 inches to 6 inches, e.g., from 1 inch to 4 inches, e.g., from 1.25 inches to 2.5 inches. The term width, as used herein, refers to the direction that is perpendicular to the longitudinal direction and the vertical direction. For example, in carrier 100, the width refers to the distance between the lower ends of the attachment projections 150 with lower hanger 160.

Figure 8:
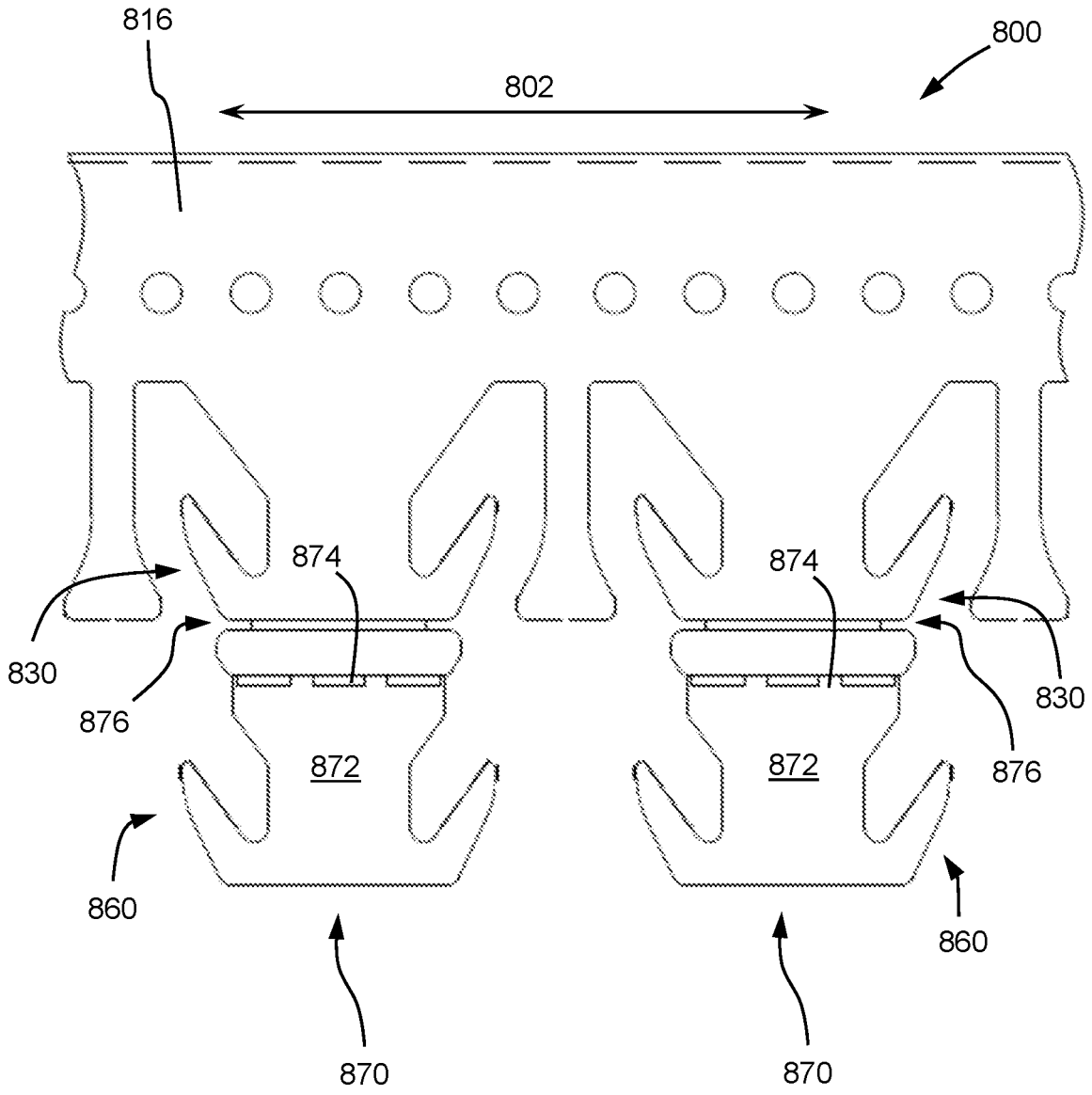
FIG. 8 is a schematic detailed plan view of a portion of a carrier according to another embodiment of the disclosure.
Figure 9:
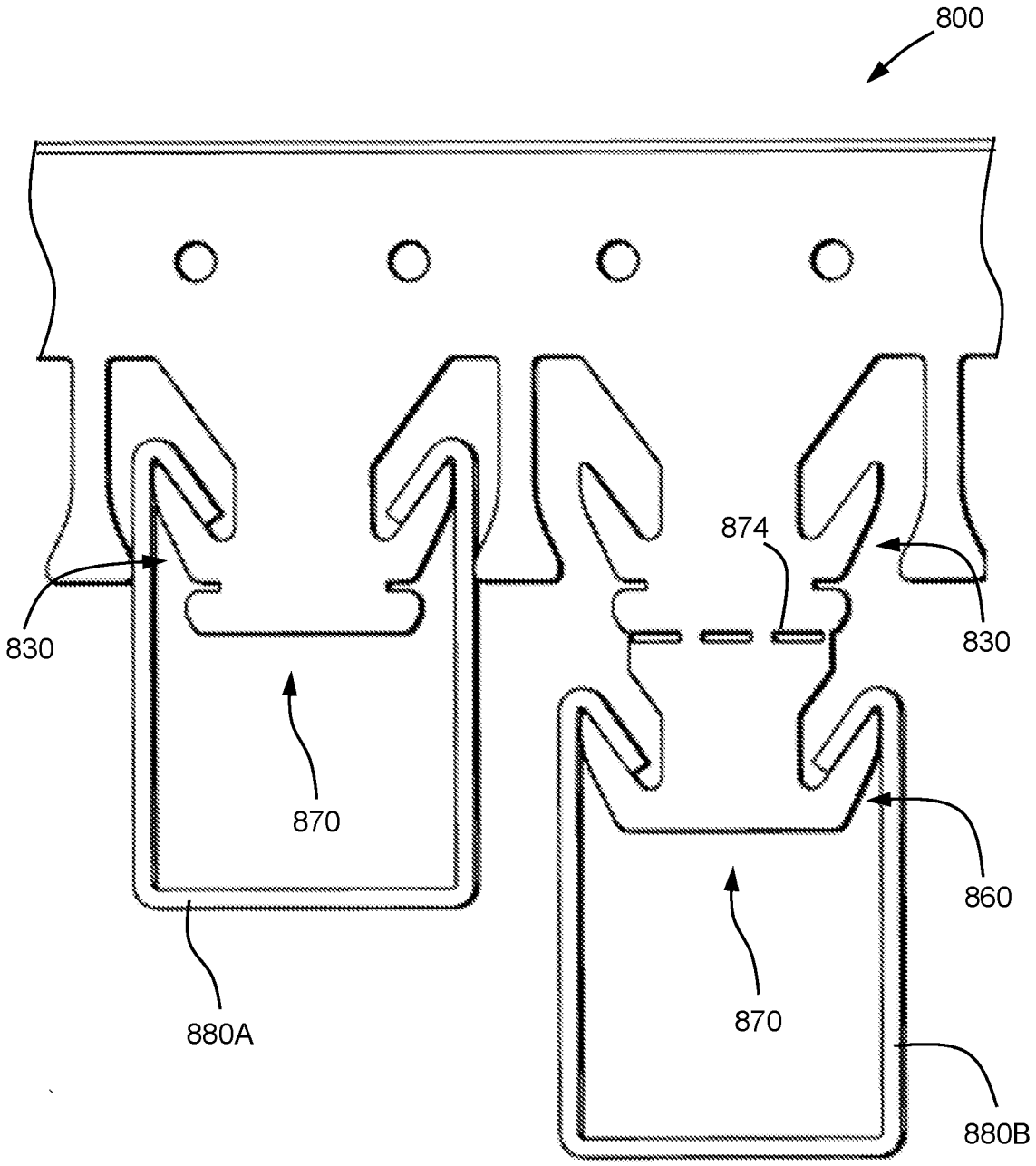
FIG. 9 is a schematic detailed plan view of a ceiling system according to an embodiment of the disclosure that uses the carrier of FIG. 8.

In certain embodiments of the carrier as otherwise described herein, at least a portion of the attachment projections are double hangers and include both an upper hanger and a lower hanger. A plan view of a portion of such an embodiment of a carrier is shown in FIG. 8. Carrier 800 includes a support structure 816 that extends in a longitudinal direction 802 and includes a plurality of attachment projections in the form of double hangers 870. Each of the double hangers 870 includes an upper hanger 830 as well as a lower hanger 860. Accordingly, each of the double hanger 870 can hold a ceiling panel at a higher elevation or at a lower elevation. For example, FIG. 9, shows carrier 800 holding a linear ceiling panel 880A at a higher elevation on the upper hanger 830 of double hanger 870 on the left and another linear ceiling panel 880B at a lower elevation on the lower hanger 860 of the double hanger 870 on the right.

In some embodiments, the carrier includes some attachment projections that only include upper hangers, some attachment projections that only include lower hangers, and some attachment projections that are double hangers. Thus, such a carrier includes a first group of attachment projections that include upper hangers and a second group of attachment projections that include lower hangers, where the double hangers are part of both the first group and the second group. In other words, the double hangers result in some overlap between the first group of attachment projections and the second group of attachment projections. Moreover, in some embodiments, all of the attachment projections are double hangers and the first and second groups entirely overlap.

In other embodiments, the first group of attachment projections and the second group of attachment projections are mutually exclusive. In other words, in some embodiments, no attachment projection that forms part of the first group also forms part of the second group. For example, in carrier 100, each of the attachment projections 120 is in the first group, and each of the attachment projections 150 is in the second group, and there are no attachment projections in both groups.

In certain embodiments of the carrier as otherwise described herein, at least a portion of the double hangers include a perforation between the upper hanger and the lower hanger configured to facilitate removal of the lower hanger from the upper hanger. For example, each of the double hangers 870, shown in FIG. 8, includes a perforation 874 that extends across the body 872 of the attachment projection 870 in the longitudinal direction. The perforation 874 is positioned below the upper hanger 830, such that the lower end of the double hanger 870, including the lower hanger 860 can be removed from the upper hanger 830. Alternatively, the perforation 874 may also be used to bend the lower hanger upward to a horizontal position.

Figure 10:
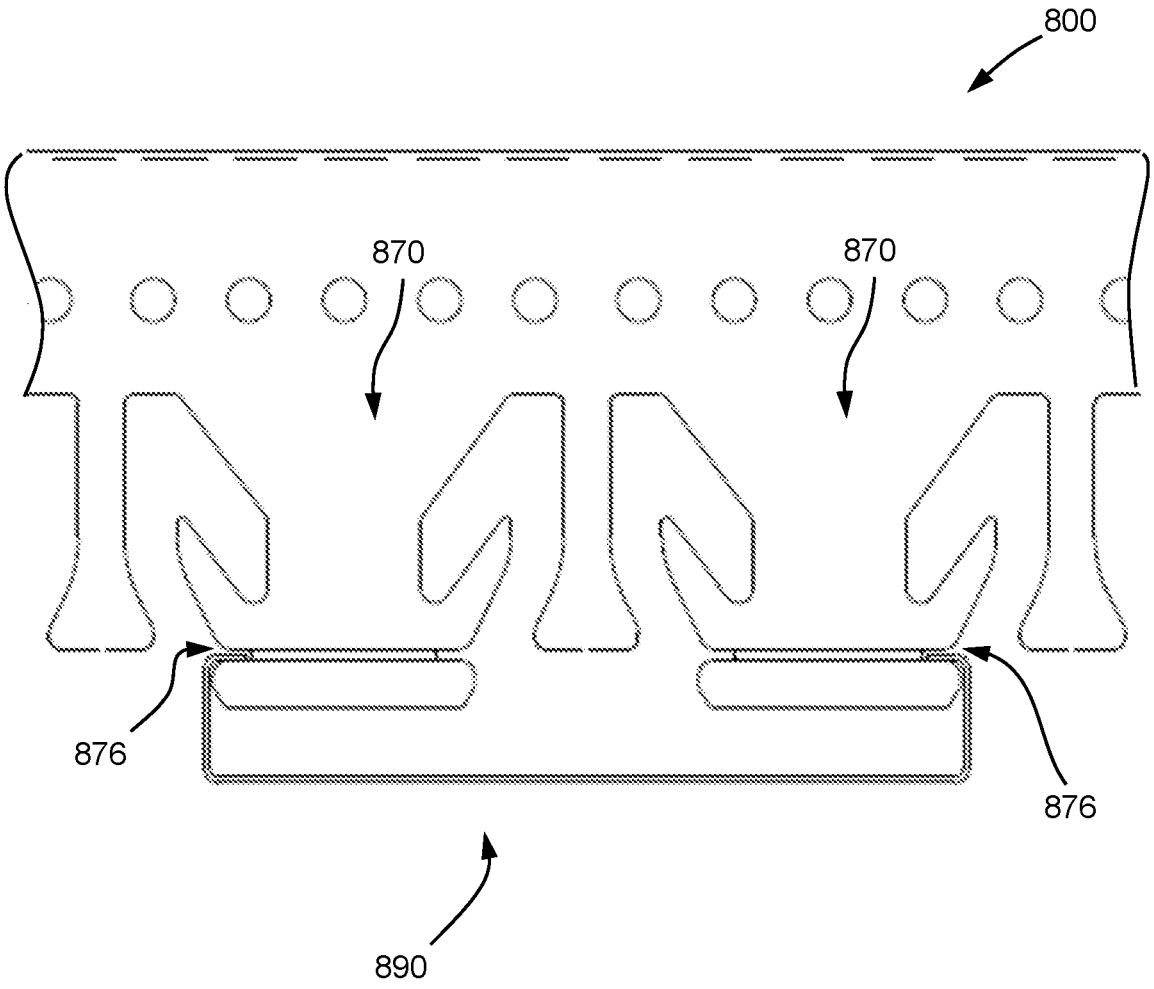
FIG. 10 is a schematic detailed plan view of a ceiling system according to another embodiment of the disclosure that uses the carrier of FIG. 8.

In certain embodiments of the carrier as otherwise described herein, at least a portion of the attachment projections includes a notch configured to receive an edge of a ceiling panel. For example, each of the double hangers 870 of carrier 800 include such a notch 876 in a side surface of the body 872 thereof. The notch extends in the longitudinal direction so as to allow lateral engagement of the ceiling panel with respect to the attachment projection. In particular, the notch 876 in the side of the attachment projection is configured to receive an edge of a ceiling panel having a different configuration than those described above. For example, FIG. 10 shows two attachment projections 870 with the lower hangers removed. A wide ceiling panel 890 extends across both attachment projections and includes a fastening edge inserted into a respective notch 876 of each attachment projection 870.

In certain embodiments of the carrier as otherwise described herein, a length of the carrier is at least 3 feet, e.g., at least 6 feet, e.g., at least 8 feet. The length of the carrier can vary depending the size of the ceiling that is being installed and the number of ceiling panels required. In some embodiments, the length of the carrier is limited by manufacturing and transportation limitations. For example, in some embodiments, the carrier is no more than 50 feet, e.g., no more than 25 feet. In other embodiments, the carrier is longer.

In certain embodiments of the carrier as otherwise described herein, the carrier is formed from a bent metal sheet. The term metal sheet, as used herein, is not limited to any particular thickness and may include materials conventionally referred to as metal foil, sheet metal, metal plate, or metal strips. For example, carrier 100 is formed from a sheet of metal that is cut to shape to form the attachment projections 120, 150 and bent along its length to form the first leg 112, second leg 114 and central portion 110. In some embodiments, the carrier is formed of bent steel. In other embodiments, the carrier is formed of aluminum or another metal. In other embodiments the carrier is formed of another material, for example, plastic or wood.

In another aspect, the disclosure provides a ceiling panel system including a first carrier according to the disclosure and first and second linear panels secured to the first carrier. The first linear panel is secured to the upper hanger of a first attachment projection of a first group of attachment projections of the first carrier, and the second linear panel is secured to the lower hanger of a first attachment projection of the second group of attachment projections.

Figure 5:
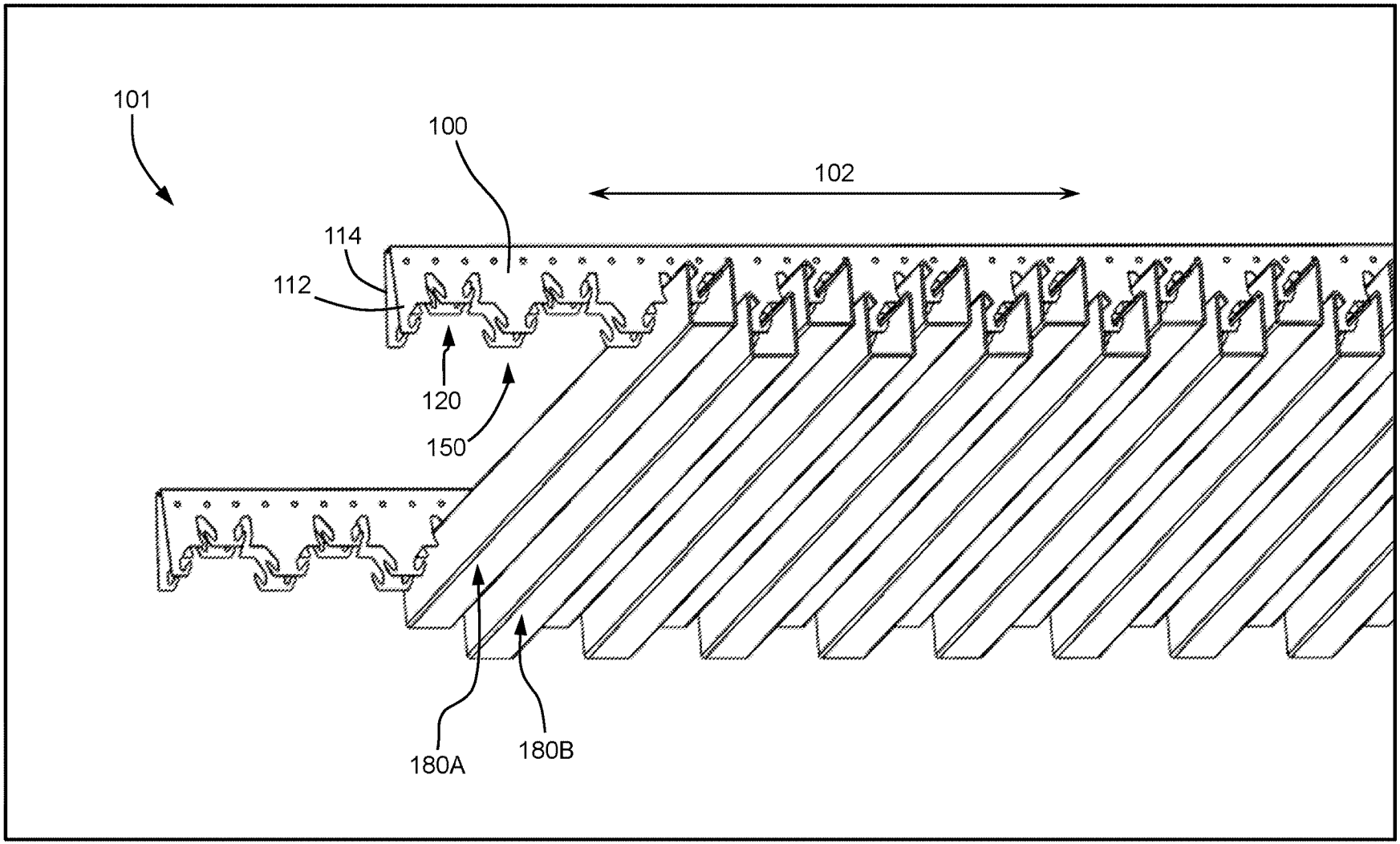
FIG. 5 is a schematic perspective bottom view of a ceiling system according to an embodiment of the disclosure.
Figure 6:
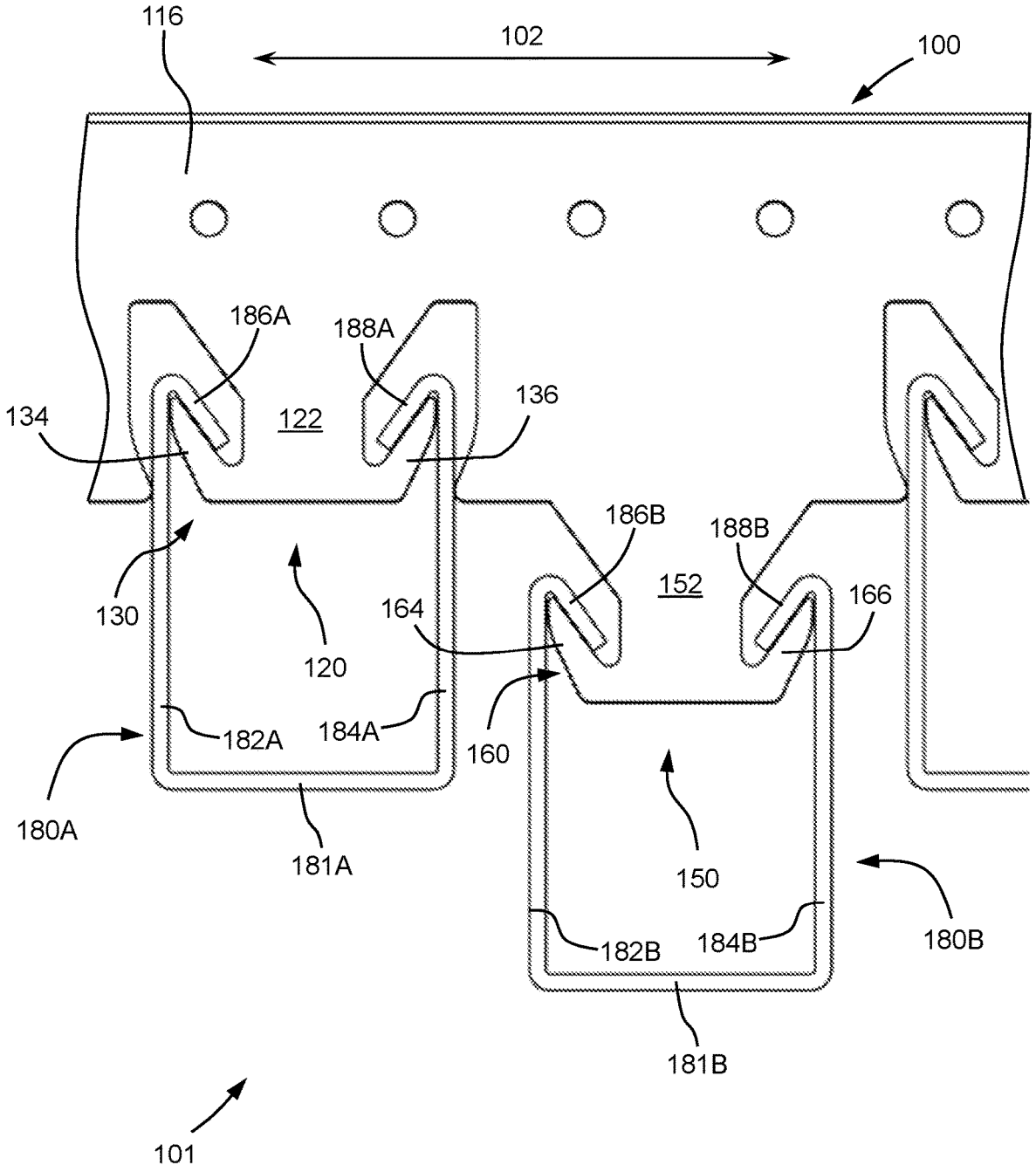
FIG. 6 is a schematic side view of a portion of the ceiling system of FIG. 5.

An embodiment of such a ceiling panel system is shown in FIGS. 5 and 6. System 101 includes a first carrier 100 that extends in a longitudinal direction 102 and supports a plurality of linear panels, such as linear panels 180A and 180B. Several of the linear panels are removed from the image in FIG. 5, in order to more clearly show the structure of the first carrier 100. In particular, carrier 100 has a plurality of attachment projections 120, 150 extending along its length. As shown more clearly in FIG. 6, a first group of the attachment projections 120 each includes an upper hanger 130 positioned at an upper elevation. On the other hand, a second group of attachment projections 150 each includes a lower hanger 160 positioned at a lower elevation. Ceiling panel system 101 also includes a first linear panel 180A secured to the upper hanger 130 of a first attachment projection 120 that is part of the first group of attachment projections. Further, ceiling panel system 101 also includes a second linear panel 180B that is secured to the lower hanger 160 of a first attachment projection 150 that is part of the second group of attachment projections.

In certain embodiments of the ceiling system as otherwise described herein, each of the first linear panel and the second linear panel extends in a lateral direction that is substantially perpendicular to the longitudinal of the carrier. For example, the attachment projections 120, 150 of first carrier 100 are configured to engage with features of the cross-sectional shape of the linear panels 180A, 180B such that the linear panels run across the carrier 100 and are held substantially perpendicular to carrier 100. In other embodiments, the carrier is configured to hold the linear panels at a different angle.

In certain embodiments of the ceiling system as otherwise described herein, a cross section of the first linear panel along the length thereof includes a first sidewall and a first lip disposed at an angle to the first sidewall. The first lip engages the first upper flange of the upper hanger of the first attachment projection such that the first linear panel hangs from the first upper flange. Further, in some embodiments, the cross section of the first linear panel includes a second sidewall connected to the first sidewall by a central portion and a second lip disposed at an angle to the second sidewall. Similar to the first lip, the second lip engages the second upper flange of the upper hanger of the first attachment projection. For example, as shown in FIG. 6, linear panel 180A has a cross section along its length that includes a first sidewall 182A and a second sidewall 184A that are connected at the bottom by a central portion 181A. At the upper end of first sidewall 182A, a first lip 186A is disposed at an angle to first sidewall 182A and engages the first upper flange 134 of upper hanger 130. Likewise, at the upper end of second sidewall 184A, a second lip 188A is disposed at an angle to second sidewall 184A and engages the second upper flange 136 of upper hanger 130. The resulting engagement of the two lips 186A, 188A over the first and second upper flanges 134, 136 allows first linear panel 180A to hang on the first attachment projection 120.

In certain embodiments of the ceiling system as otherwise described herein, the first and second lips of the first linear panel extend toward each other. For example, as shown in FIG. 6, first lip 186A extends toward second lip 188A while second lip 188A extends toward first lip 186A. Accordingly, the first linear panel 180A partially wraps around upper hanger 130 of attachment projection 120 so as to retain the first linear panel 180A on the attachment projection 120.

In certain embodiments of the ceiling system as otherwise described herein, a cross section of the first carrier along the length thereof includes first and second legs connected by a central portion, the first attachment projection is disposed on the first leg and is paired with a second attachment projection disposed on the second leg, and the first linear panel is supported by the first attachment projection and the second attachment projection. For example, as shown in FIG. 4 and explained above, carrier 100 includes a first leg 112 and a second leg 114 that are connected by a central portion 110. Attachment projections 120, 150 are included on both legs 112, 114. Further, as can be seen in FIG. 5, the first linear panel 180A is supported by a pair of attachment projections that are respectively provided on the first let 112 and second leg 114 of carrier 100.

In certain embodiments of the ceiling system as otherwise described herein, the first attachment projection of the first group of attachment projections is adjacent to the first attachment projection of the second group of attachment projections. Further, in some embodiments, the first linear panel provides a guard for the second linear panel. For example, as shown in FIG. 6, first attachment projection 120 of the first group of attachment projections is adjacent to the first attachment projection 150 of the second group of attachment projections. Accordingly, first linear panel 180A, which is attached to first attachment projection 120 of the first group of attachment projections, is adjacent to first linear panel 180B, which is attached to first attachment projection 150 of the second group of attachment projections. Because of the close proximity between first linear panel 180A and second linear panel 180B, first linear panel 180A can act as a guard for second linear panel 180B and help retain second linear panel 180B on first attachment projection 150 of the second group of attachment projections.

In particular, in some embodiments, a cross section of the second linear panel along the length thereof includes a first sidewall and a first lip disposed at an angle to the first sidewall, the first lip engages the first lower flange of the lower hanger of the second attachment projection such that the second linear panel hangs from the first lower flange, and a width of a first lip of the second linear panel is greater than a distance between the first linear panel and the second linear panel. For example, similar to first linear panel 180A, second linear panel 180B has a cross section along its length that includes a first sidewall 182B and a second sidewall 184B that are connected at the bottom by a central portion 181B. At the upper end of first sidewall 182B, a first lip 186B is disposed at an angle to first sidewall 182B and engages the first lower flange 164 of lower hanger 160. Likewise, at the upper end of second sidewall 184B, a second lip 188B is disposed at an angle to second sidewall 184B and engages the second lower flange 166 of lower hanger 160. The width of the first lip 186B, which is described herein as the dimension along the cross section of the linear panel 180B that the first lip 186B extends from the upper end of first sidewall 182B, is larger than the distance between first linear panel 180A and second linear panel 180B. Accordingly, if the second linear panel 180B begins to disengage from the attachment projection 150 such that first sidewall 182B is shifting toward the first linear panel 180A, the first sidewall 182B of second linear panel 180B will bump up against first linear panel 180A before first lip 186B has disengaged from first lower flange 164. Thus, the close proximity of the linear panels 180A, 180B helps retain the panels on the carrier.

In some embodiments, the first and second linear panels have similar constructions and the difference in elevation between the lower visible surface of the linear panels is a function of the shape of the carrier. For example, in certain embodiments of the ceiling system as otherwise described herein, a height of the first linear panel is the same as the height of the second linear panel. Likewise, in certain embodiments of the ceiling system as otherwise described herein, a cross-sectional shape of the first linear panel is the same as the cross-sectional shape of the second linear panel. For example, as shown in FIG. 6, the first linear panel 180A and the second linear panel 180B have the same cross-sectional shape and, thus, the same height. However, the difference in the elevations of the upper hanger 130 and the lower hanger 160 causes the linear panels 180A, 180B to hang at different heights, despite the similar shape of the panels.

In certain embodiments of the ceiling system as otherwise described herein, each of the first linear panel and second linear panel includes a fibrous non-woven material. For example, in some embodiments, the linear panels of the ceiling system include a felt material. Moreover, in some embodiments, the linear panels include a thermoformable felt material. IN other embodiments, the linear panels are formed from another material. For example, in some embodiments, the linear panels are formed of metal, rubber, plastic, wood, or another material.

In certain embodiments of the ceiling system as otherwise described herein, the ceiling system further includes a second carrier that supports the first linear panel and the second linear panel. For example, as shown in FIG. 5, the ceiling system 101 includes a second carrier that supports the first linear panel 180A and second linear panel 180B at a distance from the first carrier 100. In particular, the first carrier 100 supports the linear panels 180A, 180B near one end and the second carrier supports the linear panels 180A, 180B near the opposite end. Further, in some embodiments, additional carriers are used to provide further support to the panels. In some embodiments, each of the carriers in the ceiling system have the same construction. Moreover, in some embodiments, the linear panels that are supported by an attachment projection including an upper hanger on a first carrier are also supported by an attachment projection including an upper hanger on a second carrier. Likewise, the linear panels that are supported by an attachment projection including a lower hanger on the first carrier may also supported by an attachment projection including a lower hanger on the second carrier. When the carriers are positioned at the same elevation, such a construction provides ceiling panels that are aligned at either end and extend horizontally and flat. On the other hand, in some embodiments, the linear panels are supported by an attachment projection including an upper hanger on a first carrier and an attachment projection including a lower hanger on a second carrier. In such an embodiment, each of the linear panels is disposed at a slight tilt, and the panels cross one another as they extend from one carrier to the other.

Figure 11:
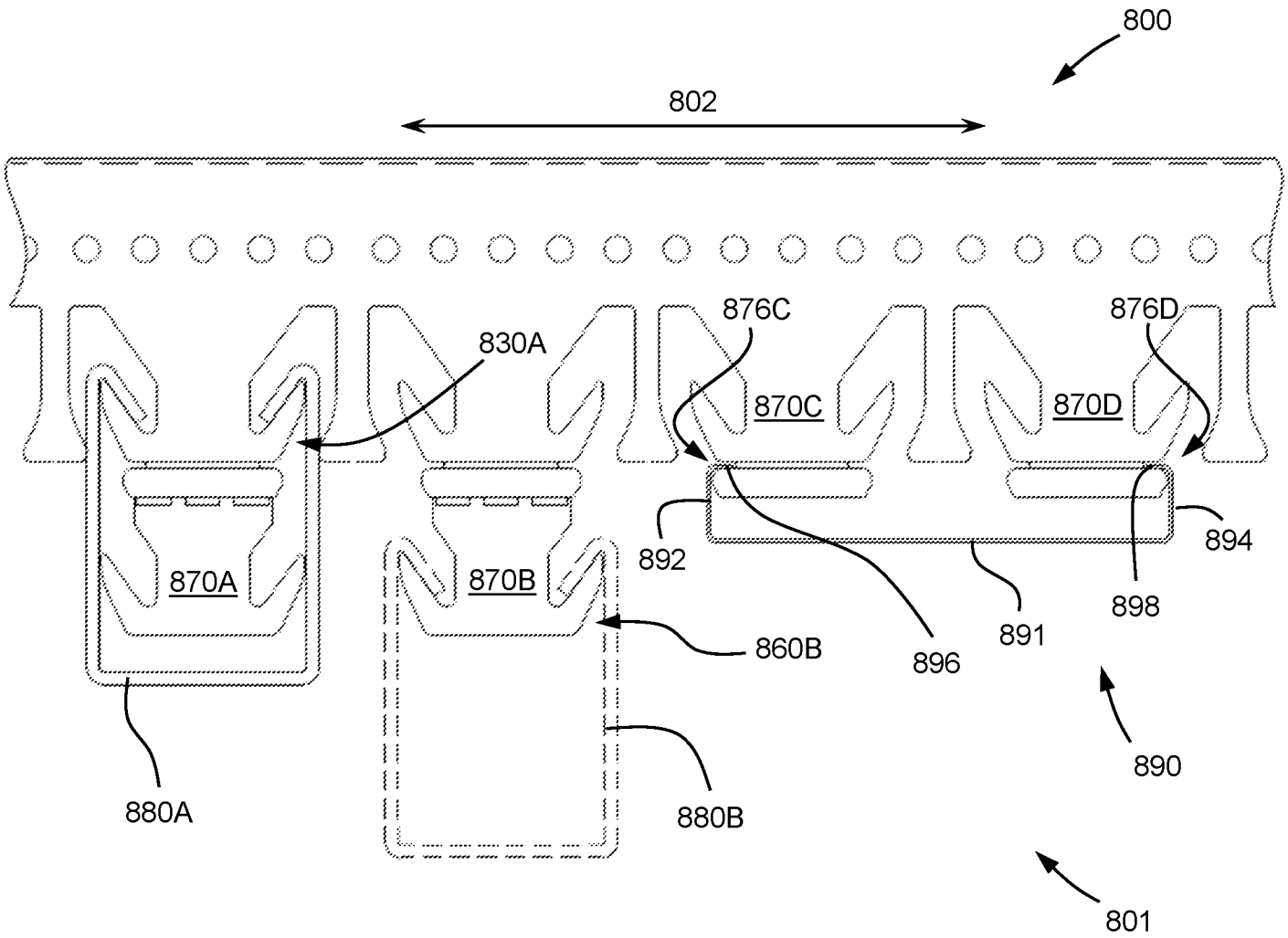
FIG. 11 is a schematic detailed plan view of a ceiling system according to another embodiment of the disclosure that uses the carrier of FIG. 8.

In certain embodiments of the ceiling system as otherwise described herein, the first carrier includes a third attachment projection and a fourth attachment projection, the third attachment projection includes a first notch on a first side thereof, the fourth attachment projection includes a second notch on a second side thereof, and the ceiling panel system further includes a wide ceiling panel including a first fastening edge inserted into the first notch of the third attachment projection and a second fastening edge inserted into the second notch of the fourth attachment projection. For example, such a ceiling system is shown in FIG. 11. Ceiling system 801 includes a first carrier 800 including an attachment projection 870A that includes an upper hanger 830A and an attachment projection 870B that includes a lower hanger 860B. A first linear ceiling panel 880A is hung from the upper hanger 830A of attachment projection 870A and a second linear ceiling panel 880B is hung from the lower hanger 860B of the attachment projection 870B.

Further, first carrier 800 also includes a third attachment projection 870C and a fourth attachment projection 870D, both of which have lower hangers removed. Third attachment projection 870C includes a first notch 876C on a first side thereof and fourth attachment projection 870D includes a second notch 876D on a second side thereof. A wide ceiling panel 890 is secured across both the third attachment projection 870C and the fourth attachment projection 870D. The wide ceiling panel 890 has a box profile and includes a lower face 891 and first and second sidewalls 892, 894 extending upward from the lower face 891. At the upper end of the first sidewall 892, a first fastening edge 896 extends inward toward the opposing second sidewall 894. Likewise, at the upper end of the second sidewall 894, a second fastening edge 898 extends inward toward the opposing first sidewall 892. The first fastening edge 896 and second fastening edge 898 are respectively disposed within the opposing notches 876C and 876D of the third attachment projection 870C and fourth attachment projection 870D. The inclusion in ceiling system 801 of two linear ceiling panels 880A and 880B at different heights as well as the wide ceiling panel 890 is facilitated by the adaptable configuration of the attachment projections 870A-870D, which are in the form of double hangers that also include notches for the wide ceiling panel 890.

In some embodiments, the wide ceiling panel is formed of a bent metal sheet. In other embodiments, the wide ceiling panel is formed of another material.

While wide ceiling panel 890 of ceiling system 801 spans two attachment projections 870C and 870D that are adjacent to one another, in other embodiments, the attachment projections engaged by the wide ceiling panel may be spaced apart. For example, in some embodiments, a wide ceiling panel can extend across a group of attachment projections and engage the notches at either end of the group of attachment projections. Thus, the third attachment projection may be spaced from the fourth attachment projection with one or more additional attachment projections disposed between the third attachment projection and fourth attachment projection.

In some embodiments, as in ceiling system 801, the ceiling system includes both linear ceiling panels and wide ceiling panels, as described above. In other embodiments, the ceiling system includes only linear ceiling panels secured to the attachment projections.

Various aspects and embodiments of the disclosure are further described by the enumerated embodiments provided below, which may be combined in any number and in any combination that is not technically or logically inconsistent:

Embodiment 1. A carrier configured to mount ceiling panels at varying heights, the carrier having a length extending in a longitudinal direction from a first end to a second end, the carrier comprising:

an elongate support structure extending in the longitudinal direction;

a plurality of attachment projections positioned along the length of the carrier, each of the attachment projections extending down from the support structure and being configured to hold a ceiling panel, the plurality of attachment projections including:

a first group of attachment projections, each attachment projection in the first group including a body and an upper hanger comprising a first upper flange extending from the body in the longitudinal direction, the upper hanger being positioned at a first elevation, and a second group of attachment projections, each attachment projection in the second group including a body and a lower hanger comprising a first lower flange from the body in the longitudinal direction, the lower hanger being positioned at a second elevation that is further from a top side of support structure than the first elevation.

Embodiment 2. The carrier according to embodiment 1, wherein the upper hanger of each attachment projection of the first group of attachment projections includes a second upper flange that extends from the respective body in a direction opposite the respective first upper flange.

Embodiment 3. The carrier according to embodiment 1 or embodiment 2, wherein the lower hanger of each attachment projection of the second group of attachment projections includes a second lower flange that extends from the respective body in a direction opposite the respective first lower flange.

Embodiment 4. The carrier according to any of embodiments 1 to 3, wherein each of the flanges is angled upward toward the support structure.

Embodiment 5. The carrier according to any of embodiments 1 to 4, wherein the first group of attachment projections are interspersed along the length of the carrier with the second group of attachment projections.

Embodiment 6. The carrier according to any of embodiments 1 to 5, wherein the first upper flange of each upper hanger of the first group of attachment projections is flanked along the longitudinal direction by a respective upper guard.

Embodiment 7. The carrier according to embodiment 6, wherein each upper guard extends from the body of a respective adjacent attachment projection of the second group of attachment projections.

Embodiment 8. The carrier according to embodiment 6 or embodiment 7, wherein the first lower flange of each lower hanger of the second group of attachment projections is flanked along the longitudinal direction by a respective lower guard.

Embodiment 9. The carrier according to embodiments 6 or embodiment 7, wherein the space between neighboring lower hangers along the length of the carrier is open.

Embodiment 10. The carrier according to any of embodiments 6 to 9, wherein each upper guard includes a protrusion extending toward a neighboring upper flange.

Embodiment 11. The carrier according to any of embodiments 1 to 10, wherein the first elevation is at a first distance from the top side of the support structure, and the second elevation is at a second distance from the top side of the support structure.

Embodiment 12. The carrier according to embodiment 11, wherein the first distance is at least 0.75 inches, e.g., at least 1 inch, e.g., at least 1.5 inches Embodiment 13. The carrier according to embodiment 11 or embodiment 12, wherein the first distance is no more than 3 inches, e.g., no more than 4 inches, e.g., no more than 5 inches.

Embodiment 14. The carrier according to any of embodiments 11 to 13, wherein the second distance is at least 1.5 inches, e.g., at least 2 inches, e.g., at least 2.5 inches.

Embodiment 15. The carrier according to any of embodiments 11 to 14, wherein the second distance is no more than 4 inches, e.g., no more than 6 inches, e.g., no more than 8 inches.

Embodiment 16. The carrier according to any of embodiments 11 to 15, wherein a difference between the first distance and the second distance is at least 0.5 inches, e.g., at least 0.75 inches.

Embodiment 17. The carrier according to any of embodiments 11 to 16, wherein a difference between the first distance and the second distance is no more than 1.5 inches, e.g., no more than 2 inches, e.g., no more than 3 inches.

Embodiment 18. The carrier according to any of embodiments 1 to 17, wherein a cross section of the carrier along the length includes first and second legs connected by a central portion, and wherein the plurality of attachment projections are formed along both legs.

Embodiment 19. The carrier according to embodiment 18, wherein each attachment projection on the first leg is paired with an attachment projection on the second leg that is disposed at the same position along the length of the carrier.

Embodiment 20. The carrier according to embodiment 18 or embodiment 19, wherein the legs are disposed at an acute angle to one another, e.g., in a range of 5 to 35 degrees.

Embodiment 21. The carrier according to any of embodiments 18 to 20, wherein the upper hangers in each pair of attachment projections of the first group of attachment projections are closer together than the lower hangers in each pair of attachment projections of the second group of attachment projections.

Embodiment 22. The carrier according to any of embodiments 1 to 21, wherein a width of the carrier is at least 0.75 inches, e.g., at least 1 inch, e.g., at least 1.25 inches.

Embodiment 23. The carrier according to any of embodiments 1 to 22, wherein a width of the carrier is no more than 6 inches, e.g. no more than 4 inches, e.g., no more than 2.5 inches.

Embodiment 24. The carrier according to any of embodiments 1 to 23, wherein at least a portion of the attachment projections are double hangers and include both an upper hanger and a lower hanger.

Embodiment 25. The carrier according to embodiment 24, wherein all of the attachment projections are double hangers.

Embodiment 26. The carrier according to embodiment 24 or embodiment 25, wherein at least a portion of the double hangers include a perforation between the upper hanger and the lower hanger configured to facilitate removal of the lower hanger from the upper hanger.

Embodiment 27. The carrier according to any of embodiments 1 to 26, wherein at least a portion of the attachment projections includes a notch configured to receive an edge of a ceiling panel.

Embodiment 28. The carrier according to any of embodiments 1 to 27, wherein a length of the carrier is at least 3 feet, e.g., at least 6 feet, e.g., at least 8 feet.

Embodiment 29. The carrier according to any of embodiments 1 to 28, wherein the carrier is formed from a bent metal sheet.

Embodiment 30. A ceiling panel system comprising:

a first carrier according to any of embodiments 1 to 29;

a first linear panel secured to the upper hanger of a first attachment projection of the first group of attachment projections; and a second linear panel secured to the lower hanger of a first attachment projection of the second group of attachment projections.

Embodiment 31. The ceiling panel system according to embodiment 30, wherein each of the first linear panel and the second linear panel extends in a lateral direction that is substantially perpendicular to the longitudinal of the carrier.

Embodiment 32. The ceiling panel system according to embodiment 31, wherein a cross section of the first linear panel along the length thereof includes a first sidewall and a first lip disposed at an angle to the first sidewall, wherein the first lip engages the first upper flange of the upper hanger of the first attachment projection such that the first linear panel hangs from the first upper flange.

Embodiment 33. The ceiling panel system according to embodiment 32, wherein the cross section of the first linear panel includes a second sidewall connected to the first sidewall by a central portion and a second lip disposed at an angle to the second sidewall, wherein the second lip engages the second upper flange of the upper hanger of the first attachment projection.

Embodiment 34. The ceiling panel system according to embodiment 33, wherein the first and second lips of the first linear panel extend toward each other.

Embodiment 35. The ceiling panel system according to any of embodiments 30 to 34, wherein a cross section of the first carrier along the length thereof includes first and second legs connected by a central portion, wherein the first attachment projection is disposed on the first leg and is paired with a second attachment projection disposed on the second leg, and wherein the first linear panel is supported by the first attachment projection and the second attachment projection.

Embodiment 36. The ceiling panel system according to any of embodiments 30 to 35, wherein the first attachment projection of the first group of attachment projections is adjacent to the first attachment projection of the second group of attachment projections.

Embodiment 37. The ceiling panel system according to embodiment 36, wherein the first linear panel provides a guard for the second linear panel.

Embodiment 38. The ceiling panel system according to embodiment 37, wherein a cross section of the second linear panel along the length thereof includes a first sidewall and a first lip disposed at an angle to the first sidewall, wherein the first lip engages the first lower flange of the lower hanger of the second attachment projection such that the second linear panel hangs from the first lower flange, and wherein a width of a first lip of the second linear panel is greater than a distance between the first linear panel and the second linear panel.

Embodiment 39. The ceiling panel system according to any of embodiments 30 to 38, wherein a height of the first linear panel is the same as the height of the second linear panel.

Embodiment 40. The ceiling panel system according to any of embodiments 30 to 39, wherein a cross-sectional shape of the first linear panel is the same as the cross-sectional shape of the second linear panel.

Embodiment 41. The ceiling panel system according to any of embodiments 30 to 40, wherein each of the first linear panel and second linear panel includes a fibrous non-woven material.

Embodiment 42. The ceiling panel system according to any of embodiments 30 to 41, further comprising a second carrier that supports the first linear panel and the second linear panel.

Embodiment 43. The ceiling panel system according to any of embodiments 30 to 42, wherein the first carrier includes a third attachment projection and a fourth attachment projection, wherein the third attachment projection includes a first notch on a first side thereof, wherein the fourth attachment projection includes a second notch on a second side thereof, and wherein the ceiling panel system further includes a wide ceiling panel including a first fastening edge inserted into the first notch of the third attachment projection and a second fastening edge inserted into the second notch of the fourth attachment projection.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended embodiments and their equivalents.

What is claimed is:

1. A carrier configured to mount ceiling panels at varying heights, the carrier having a length extending in a longitudinal direction from a first end to a second end, the carrier comprising:

an elongate support structure extending in the longitudinal direction;

a plurality of attachment projections positioned along the length of the carrier, each of the attachment projections extending down from the support structure and being configured to hold a ceiling panel, the plurality of attachment projections including:

a first group of attachment projections, each attachment projection in the first group including a body and an upper hanger comprising a first upper flange extending from the body in the longitudinal direction, the upper hanger being positioned at a first elevation, each attachment projection in the first group not further including a lower hanger; and a second group of attachment projections, each attachment projection in the second group including a body and a lower hanger comprising a first lower flange from the body in the longitudinal direction, the lower hanger being positioned at a second elevation that is further from a top side of support structure than the first elevation, each attachment projection in the second group not further including an upper hanger.

2. The carrier according to claim 1, wherein the upper hanger of each attachment projection of the first group of attachment projections includes a second upper flange that extends from the respective body in a direction opposite the respective first upper flange.

3. The carrier according to claim 1, wherein the lower hanger of each attachment projection of the second group of attachment projections includes a second lower flange that extends from the respective body in a direction opposite the respective first lower flange.

4. The carrier according to claim 1, wherein each of the flanges is angled upward toward the support structure.

5. The carrier according to claim 1, wherein the first group of attachment projections are interspersed along the length of the carrier with the second group of attachment projections.

6. A carrier configured to mount ceiling panels at varying heights, the carrier having a length extending in a longitudinal direction from a first end to a second end, the carrier comprising:

an elongate support structure extending in the longitudinal direction;

a plurality of attachment projections positioned along the length of the carrier, each of the attachment projections extending down from the support structure and being configured to hold a ceiling panel, the plurality of attachment projections including:

a first group of attachment projections, each attachment projection in the first group including a body and an upper hanger comprising a first upper flange extending from the body in the longitudinal direction, the upper hanger being positioned at a first elevation, wherein the first upper flange of each upper hanger of the first group of attachment projections is flanked along the longitudinal direction by a respective upper guard, wherein each upper guard extends from the body of a respective adjacent attachment projection of the second group of attachment projections; and a second group of attachment projections, each attachment projection in the second group including a body and a lower hanger comprising a first lower flange from the body in the longitudinal direction, the lower hanger being positioned at a second elevation that is further from a top side of support structure than the first elevation.

7. A carrier configured to mount ceiling panels at varying heights, the carrier having a length extending in a longitudinal direction from a first end to a second end, the carrier comprising:

an elongate support structure extending in the longitudinal direction;

a plurality of attachment projections positioned along the length of the carrier, each of the attachment projections extending down from the support structure and being configured to hold a ceiling panel, the plurality of attachment projections including:

a first group of attachment projections, each attachment projection in the first group including a body and an upper hanger comprising a first upper flange extending from the body in the longitudinal direction, the upper hanger being positioned at a first elevation; and a second group of attachment projections, each attachment projection in the second group including a body and a lower hanger comprising a first lower flange from the body in the longitudinal direction, the lower hanger being positioned at a second elevation that is further from a top side of support structure than the first elevation, wherein the first lower flange of each lower hanger of the second group of attachment projections is flanked along the longitudinal direction by a respective lower guard.

8. The carrier according to claim 1, wherein the first elevation is at a first distance from the top side of the support structure, and the second elevation is at a second distance from the top side of the support structure.

9. The carrier according to claim 8, wherein the first distance is at least 0.75 inches and no more than 3 inches, and the second distance is at least 1.5 inches and no more than 4 inches.

10. The carrier according to claim 1, wherein a cross section of the carrier along the length includes first and second legs connected by a central portion, and wherein the plurality of attachment projections are formed along both legs.

11. The carrier according to claim 10, wherein each attachment projection on the first leg is paired with an attachment projection on the second leg that is disposed at the same position along the length of the carrier, wherein the legs are disposed at an acute angle to one another.

12. The carrier according to claim 1, wherein at least a portion of the attachment projections includes a notch configured to receive an edge of a ceiling panel.

13. A ceiling panel system comprising:

a first carrier according to claim 1, a first linear panel secured to the upper hanger of a first attachment projection of the first group of attachment projections; and a second linear panel secured to the lower hanger of a first attachment projection of the second group of attachment projections.

14. The ceiling panel system according to claim 13, wherein each of the first linear panel and the second linear panel extends in a lateral direction that is substantially perpendicular to the longitudinal of the carrier.

15. The ceiling panel system according to claim 14, wherein a cross section of the first linear panel along the length thereof includes a first sidewall and a first lip disposed at an angle to the first sidewall, wherein the first lip engages the first upper flange of the upper hanger of the first attachment projection such that the first linear panel hangs from the first upper flange.

16. The ceiling panel system according to claim 13, wherein a cross section of the first carrier along the length thereof includes first and second legs connected by a central portion, wherein the first attachment projection is disposed on the first leg and is paired with a second attachment projection disposed on the second leg, and wherein the first linear panel is supported by the first attachment projection and the second attachment projection.

17. The ceiling panel system according to claim 13, wherein the first attachment projection of the first group of attachment projections is adjacent to the first attachment projection of the second group of attachment projections.

18. The ceiling panel system according to claim 17, wherein a cross section of the second linear panel along the length thereof includes a first sidewall and a first lip disposed at an angle to the first sidewall, wherein the first lip engages the first lower flange of the lower hanger of the second attachment projection such that the second linear panel hangs from the first lower flange, and wherein a width of a first lip of the second linear panel is greater than a distance between the first linear panel and the second linear panel.

19. A carrier configured to mount ceiling panels at varying heights, the carrier having a length extending in a longitudinal direction from a first end to a second end, the carrier comprising:

an elongate support structure extending in the longitudinal direction;

a plurality of attachment projections positioned along the length of the carrier, each of the attachment projections extending down from the support structure and being configured to hold a ceiling panel, each attachment projection of the plurality of attachment projections that are double hangers including a body an upper hanger comprising a first upper flange extending from the body in the longitudinal direction, the upper hanger being positioned at a first elevation, and a lower hanger comprising a first lower flange extending from the body in the longitudinal direction, the lower hanger being positioned at a second elevation that is further from a top side of support structure than the first elevation, and a perforation between the upper hanger and the lower hanger configured to facilitate removal of the lower hanger from the upper hanger or bending of the lower hanger into a horizontal position.

* * * * *